United States Patent [19]

Traversino et al.

[11] Patent Number: 4,814,548

[45] Date of Patent: Mar. 21, 1989

[54] AUDIO CABLE

[76] Inventors: Michael A. Traversino, 21000 Parthenia St., #22, Canoga Park, Calif. 91304; Richard D. Katz, 15015 Ventura Blvd., #614, Sherman Oaks, Calif. 91403

[21] Appl. No.: 170,843

[22] Filed: Mar. 21, 1988

[51] Int. Cl.[4] ..... H01B 11/00; H01B 7/08

[52] U.S. Cl. ..... 174/115; 174/113 R; 174/114 R; 174/117 F

[58] Field of Search ..... 174/113 R, 113 AS, 114 R, 174/115, 117 R, 117 F, 117 AS, 119 R

[56] References Cited

U.S. PATENT DOCUMENTS

| | | | |
|---|---|---|---|
| 642,738 | 2/1900 | Borel | 174/114 R |
| 1,755,930 | 4/1930 | Middleton | 174/114 R |
| 1,952,191 | 3/1934 | Arutunoff | 174/114 R |
| 1,994,128 | 3/1935 | Foust | 315/214 R |
| 2,066,525 | 1/1937 | Gilbert | 174/114 S |
| 2,585,037 | 2/1952 | Robinson et al. | 338/263 |
| 2,626,303 | 1/1953 | Link | 174/117 AS |
| 2,666,093 | 1/1954 | Wildberg | 174/113 R |
| 3,164,669 | 1/1965 | Meyerhoff | 174/114 R |
| 3,164,670 | 1/1965 | Ege | 174/114 R |
| 3,651,243 | 3/1972 | Hornor et al. | 174/115 X |
| 3,660,592 | 5/1972 | Anderson | 174/114 R |
| 4,039,743 | 8/1977 | Gommans | 174/114 R |
| 4,081,602 | 3/1978 | Paniri et al. | 174/115 X |
| 4,510,346 | 4/1985 | Bursh, Jr. et al. | 174/36 |
| 4,538,023 | 8/1985 | Brisson | 174/115 |
| 4,692,731 | 9/1987 | Osinga | 174/114 R X |

FOREIGN PATENT DOCUMENTS

| | | | |
|---|---|---|---|
| 12100 | 6/1980 | European Pat. Off. | 174/117 F |

*Primary Examiner*—Morris H. Nimmo
*Attorney, Agent, or Firm*—Jack C. Munro

[57] ABSTRACT

An audio cable formed of a mass of wires which are wound together into a first group and a second group, the wires of the first group are electrically connected together by the wires being coated with an electrically conductive material such as a tin alloy. The wires of the first group are to facilitate the conducting of low frequency audio signals. The wires of the second group are electrically insulated relative to each other with each wire being coated with an electrically insulating material such as enamel. It is function of the wires of the second group to facilitate the conducting of the higher frequency audio signals. The second group is wound in a twisted manner about the wires of the first group.

6 Claims, 1 Drawing Sheet

AUDIO CABLE

BACKGROUND OF THE INVENTION

The field of this invention relates to the transmission of sound and more particularly to the construction of cable which enhances the transmission of both high frequency and low frequency audio signals.

There is a constant effort to manufacture the best possible sound reproduction equipment. Improvements are occurring frequently. Generally, these improvements have been concentrated in extracting sound from a tape or disc and reproducing the sound as close as possible to the original production. The speakers which are utilized to emit the sound have also been substantially improved to effect accurate reproduction.

Connecting between the speakers and reproduction equipment are cables. The sound reproduction equipment is only as good as the audio transmission cable. If the audio transmission cable constitutes a weak link in the chain, then the full advantage of the quality of the sound reproduction equipment and speakers is not being taken.

In the past, there have been attempts trying to improve the quality of cables. Some of these attempts have resulted in improvements in the conducting of the audio signals between the sound reproduction equipment and the speakers. However, there is a need to further improve audio cables especially in view of the high level of technology that is now being utilized in the constructing of the sound reproduction equipment and speakers.

SUMMARY OF THE INVENTION

An audio cable which is to be constructed of a mass of wires defining a typical circular shape in transverse cross-section. The wires centrally disposed within this cable are defined as a first group. The wires surrounding the first group are defined as a second group. Each of the wires within the first group are coated with an electrically conductive material such as tin alloy. The wires of the second group are coated with an electrically insulative material such as enamel. The transmission of the low frequency audio signals is facilitated through the first group of wires. The higher frequency audio signals are found to be conducted best through the second group of wires. The first group of wires are to be twisted upon themselves and the second group of wires being twisted upon the first group. It is preferable to enclose the conductor produced by both the first group and the second group by an electrical insulating sheath. It will be necessary to have two of the electrical conductors encased by the sheath (producing the cable) in order to complete the electrical circuit. It is preferable to separate these electrical conductors by the sheath to prevent interaction of the electric fields about each of the conductors. A preferable spacing would be about 1.9 centimeters between the centers of the conductors which is the spacing of the standard speaker and amplifier connector.

The primary objective of the present invention is to construct an audio cable which accurately transmits the signal between the sound reproduction equipment and the speakers.

DETAILED DESCRIPTION OF THE SHOWN EMBODIMENT

In the past, it has been common to utilize bare copper wire to transmit audio signals. One of the big disadvantages of bare copper is that it oxidizes very quickly. This oxidation creates resistance to flow of electrons on the surface of the wire. It has been known in the past that if the bare copper wires are coated with an insulating material that this coating will tend to prevent oxidation. In the past, this insulative coating of wires is utilized throughout the entire cross-section of the wire.

It has been found that lower frequencies of an audio signal penetrate deeper into the wire and travel across the entire cross-section of the wire. Higher frequencies travel within the wire closer to the surface of the wire. It is to be understood that lower frequency is anything from twenty to one thousand cycles per second. Higher frequencies are from one thousand cycles per second to twenty thousand cycles per second.

It has been found that if a wire utilized a mass of twisted bare wires, low frequencies within the audio signal would be conducted most satisfactorily. It seems that the conducting of these low frequencies is minimally affected by the jumping of the signal from one bare wire to another bare wire. However, in the conducting of high frequencies, bare wire is not satisfactory since there will be noise/distortion created as the signal jumps between the bare wires. An audio cable composed of a mass of electrically insulated wires will keep the higher frequencies from jumping from one wire to another. However, with this type of cable the transmission of the lower frequencies is diminished.

Also, as previously mentioned, high frequencies travel best close to the surface of a wire (skin effect). By using a mass of wires, insulated relative to each other, a substantially greater amount of surface area is obtained. Therefore, the conducting of the higher frequencies is enhanced.

Also, during the conducting of any electrical energy along a conductor there is created an electric field about that conductor. If two conductors are located side-by-side, so that their electric fields overlap, the overall signal transmission characteristics of the cables are undesirably affected. A single audio cable has to have at least two conductors in order to complete the circuit. It has been known in the past to space apart these conductors some small distance so as to minimize the affect of the electric field between the two conductors.

Figure 1:
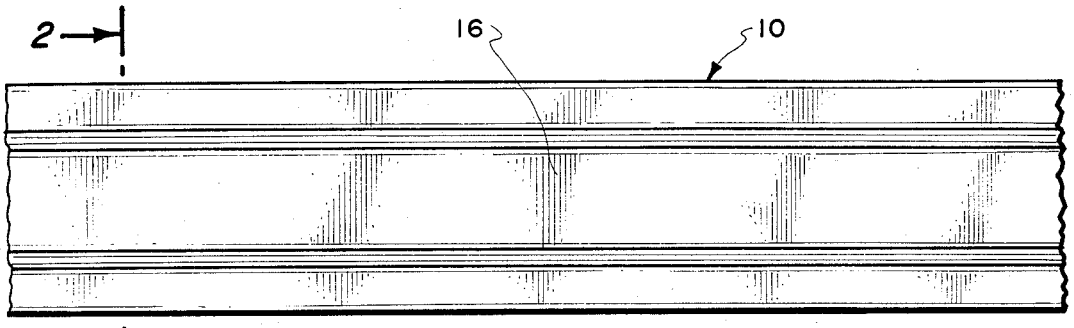
FIG. 1 depicts a longitudinal section of the audio cable constructed in accordance with the present invention.
Figure 2:
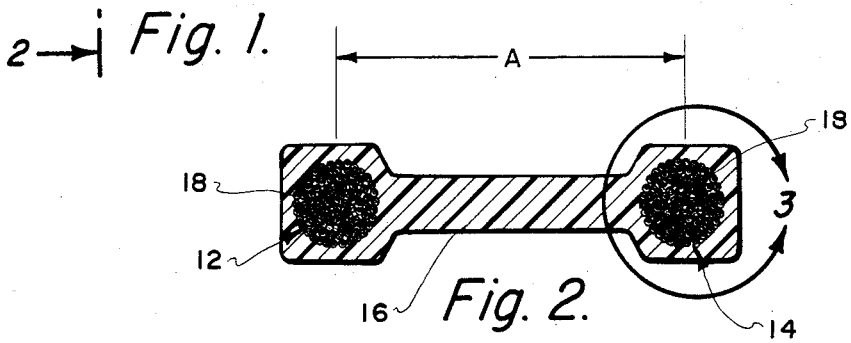
FIG. 2 is a cross-sectional view taken along line 2—2 of FIG. 1.

Referring particularly to the drawing there is shown an audio cable 10 constructed in accordance with this invention. Cable 10 includes a pair of spaced apart conductors 12 and 14. The conductors 12 and 14 are constructed in the same manner and are essentially identical. The conductors 12 and 14 are covered by an electrically insulated sheath 16 which generally will comprise some form of a rubber or plastic or combination thereof. It is to be noted that when referring to FIG. 2, that the center line distance between the conductors 12 and 14 is represented by the letter "A". The preferable distance for "A" will be approximately three-quarters of an inch which is generally in the range of 1.9 centimeters. Generally, the diameter of each of the cables 12 and 14 will be approximately one-fourth of an inch which equals 0.45 centimeters.

Figure 3:
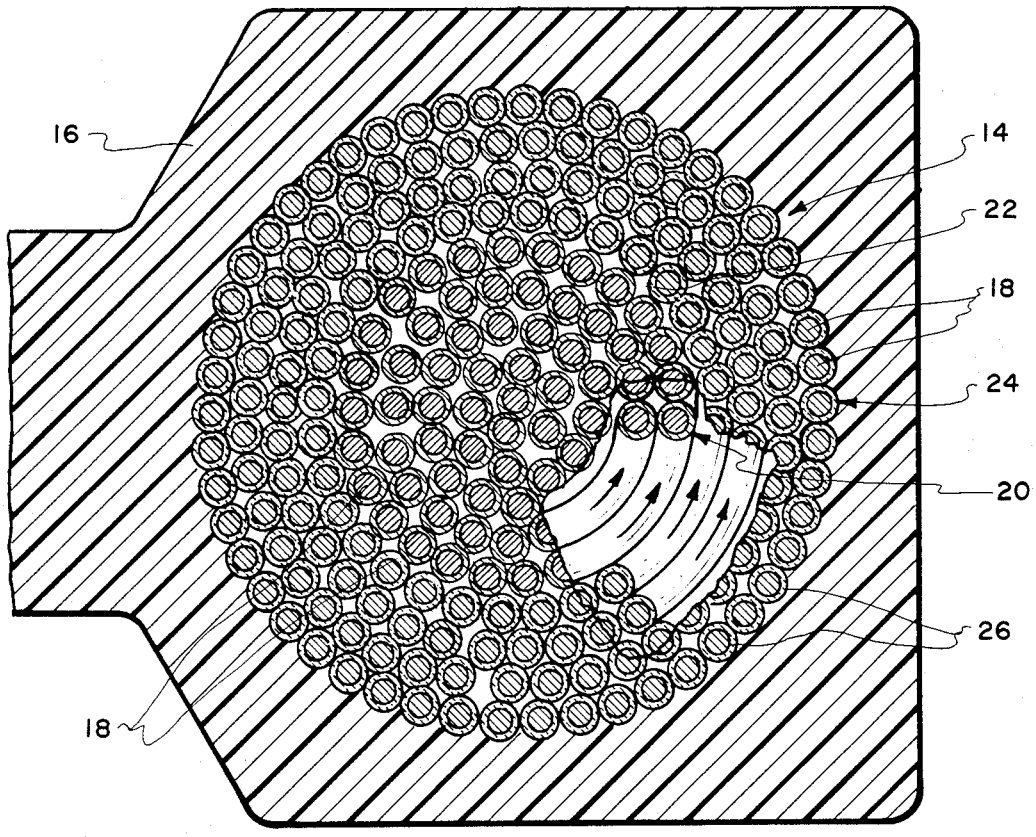
FIG. 3 is an enlarged view in cross-section of a portion of the audio cable of FIG. 2 taken along line 3—3 of FIG. 2.

In referring particularly to FIG. 3, the conductor 12 is constructed of a mass of individual wires 18. The wires 18 will normally be of the same size. However, it is possible within the scope of this invention that different wire sizes could be utilized. The desirable wire size would be what is termed thirty-eight gauge with the size of the overall conductor 12 being a twelve gauge.

The mass of wires centrally disposed within the conductor 12 is what is termed the first group 20. These wires 20 are each coated with a coating 22. This coating 22 is to be electrically conductive with generally a tin-/alloy composition being preferred. This first group 20 is to be utilized primarily for the conducting of low frequencies of the audio signal.

Surrounding the first group 20 is a second group 24. Each wire of the second group 24 is completely covered with an insulative coating 26 such as enamel. It is the purpose of the second group 24 to facilitate the conducting of higher frequencies of the audio signal.

It is common to construct a conductor by helically twisting of the wires of the conductor along the entire longitudinal length of the conductor. This twisting of the wires holds the conductor together into a single integral unit and also seems to facilitate the conducting of the signals through the conductor. The wires of the first group 20 are twisted together. Similarly, the wires of the second group 24 are twisted together and twisted onto the first group 20.

It is considered to be within the scope of this invention to use conductor 14 within a shielded cable, such as coaxial or twinaxial, for the interconnection of audio equipment. It is in the scope of the invention that the conductors can be shaped at a different distance apart or can be twisted together.

What is claimed is:

1. An audio cable comprising:

a first group of a plurality of electrically conductive wires, said first group having a substantially circular cross-sectional configuraiton, each said wire of said first group being coated with an electrically conductive material, the function of said first group being to facilitate the conducting of low frequency audio signals, said wires of said first group are in full electrical contact with each other to form a single conducting path; and a second group of a plurality of electrically conductive wires, said second group having a substantially circular cross-sectional configuration, said second group being wound around said first group forming a single electrical conductor composed of said first group and said second group, each said wire of said second group being coated with an electrically insulative material, the function of said second group being to facilitate the conducting of high frequency audio signals, each said wire of said second group forming a separate conducting path and thus forming a plurality of said separate conducting paths within said second group.

2. The audio cable as defined in claim 1 wherein:

said first group of electrically conductive wires is twisted.

3. The audio cable as defined in claim 2 wherein:

said second group of electrically conductive wires is twisted.

4. The audio cable as defined in claim 1 wherein:

said electrically conductive material comprises a tin alloy and the electrically insulative material comprises enamel.

5. The audio cable as defined in claim 1 including:

a sheath, said sheath being electrically insulative, said sheath enclosing said single electrical conductor.

6. The audio cable as defined in claim 5 wherein:

therebeing utilized a pair of said single electrical conductors located in a spaced apart arrangement with the spacing in excess of one and one-fourth centimeters, said sheath enclosing both of said single electrical conductors.

* * * * *

UNITED STATES PATENT AND TRADEMARK OFFICE

CERTIFICATE OF CORRECTION

PATENT NO. : 4,814,548

DATED : Mar. 21, 1989

INVENTOR(S) : Michael A. Traversino and Richard D. Katz

It is certified that error appears in the above—identified patent and that said Letters Patent is hereby corrected as shown below:

Column 3, line 41 of the Patent, change "shaped" to ---spaced---.

Signed and Sealed this

Twenty-sixth Day of September, 1989

*Attest:*

DONALD J. QUIGG

*Attesting Officer*

*Commissioner of Patents and Trademarks*